US007444847B2

(12) United States Patent
Lixfeld et al.

(10) Patent No.: US 7,444,847 B2
(45) Date of Patent: Nov. 4, 2008

(54) METHOD FOR INCREASING THE PROCESS STABILITY, PARTICULARLY THE ABSOLUTE THICKNESS PRECISION AND THE INSTALLATION SAFETY DURING THE HOT ROLLING OF STEEL OR NONFERROUS MATERIALS

(75) Inventors: Peter Lixfeld, Hilchenbach (DE); Ulrich Skoda-Dopp, Duisburg (DE); Harald Wehage, Ilsenburg (DE); Wolfgang Grimm, Ilsenburg (DE); Alexander Borowikow, Grüntal (DE); Holger Blei, Berlin (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/586,989

(22) PCT Filed: Jan. 14, 2005

(86) PCT No.: PCT/EP2005/000348

§ 371 (c)(1),
(2), (4) Date: Jun. 8, 2007

(87) PCT Pub. No.: WO2005/070575

PCT Pub. Date: Aug. 4, 2005

(65) Prior Publication Data

US 2007/0256464 A1 Nov. 8, 2007

(30) Foreign Application Priority Data

Jan. 23, 2004 (DE) ..... 10 2004 003 514

(51) Int. Cl.
*B21B 37/00* (2006.01)

(52) U.S. Cl. ..... 72/6.2; 72/8.5; 72/9.2; 72/10.7; 700/148; 700/28; 700/108

(58) Field of Classification Search ..... 700/28, 700/148, 108, 109, 154, 155; 72/6.2, 8.5, 72/9.2, 6.1, 7.4, 8.3, 8.4, 9.3, 9.4, 10.8–11.2, 72/12.1, 12.6, 13.1–13.3, 14.6, 14.7
See application file for complete search history.

(56) References Cited

FOREIGN PATENT DOCUMENTS

| | | |
|---|---|---|
| WO | 93/11886 | 6/1993 |
| WO | 99/02282 | 1/1999 |

OTHER PUBLICATIONS

"Modellierung des Einflusses der chemischen Zusammensetzung auf die Fliessspannung von Stählen", M. Spittel & T. Spittel, 1996, pp. 9/1-9/25.

"Kraft- und Arbeitsbedarf bildsamer Formgebungs- verfahren", A. Hensel & T. Spittel, 1978, pp. 85, 88 and 95.

*Primary Examiner*—Dmitry Suhol
(74) *Attorney, Agent, or Firm*—Friedrich Kueffner

(57) ABSTRACT

The invention relates to a method for increasing the process stability, particularly the absolute thickness precision and the installation safety during the hot rolling of steel of nonferrous materials, with small degrees of deformation (f) or no reductions while taking the high-temperature limit of elasticity ($R_e$) into account when calculating the set rolling force ($F_w$) and the respective setting position (s). The process stability can be increased with regard to the precision of the yield stress ($k_{f,R}$) and the set rolling force ($F_w$) at small degrees of deformation (f) or small reductions, during which the high temperature limit of elasticity ($R_e$) is determined according to the deformation temperature (T) and/or the deformation speed (phip) and is integrated into the function of the yield stress ($k_f$) for determining the set rolling force ($F_w$) via the relation (2) $R_e = a + e^{b1+b2\cdot T}.\text{phip}^c$, in which: $R_e$ represents the high temperature; phip represents the deformation speed, and; a, b, c represent coefficients.

4 Claims, 1 Drawing Sheet

METHOD FOR INCREASING THE PROCESS STABILITY, PARTICULARLY THE ABSOLUTE THICKNESS PRECISION AND THE INSTALLATION SAFETY DURING THE HOT ROLLING OF STEEL OR NONFERROUS MATERIALS

The invention concerns a method for increasing process stability, especially absolute gage precision and plant safety, in the hot rolling of steel or nonferrous materials with small degrees of deformation or small reductions, taking into account the yield point at elevated temperature when calculating the set rolling force and the given adjustment position.

Two earlier publications, "Kraft und Arbeitsbedarf bildsamer Formgebungsverfahren" ["Power and Work Requirement of Plastic Deformation Processes"] by A. Hensel and T. Spittel, Leipzig, 1978, and "Rationeller Energieeinsatz bei Umformprozessen" ["Economical Energy Use in Deformation Processes"] by T. Spittel and A. Hensel, Leipzig, 1981, describe various methods for determining the set rolling force in hot rolling as the product of deformation resistance and compressed surface area. The deformation resistance itself is determined as the product of the flow stress and a factor that takes into account the roll gap geometry and/or friction conditions. The most frequently used method for determining the flow stress is its determination by a relation with influencing factors that take into account the deformation temperature, degree of deformation, and deformation rate, which are combined with one another by multiplication, e.g., in the following form:

$$k_f = k_{f0} \cdot A_1 \cdot e^{m1 \cdot T} \cdot A_2 \cdot \square^{m2} \cdot A_3 \cdot \square p^{m3} \quad (1)$$

where $k_f$=flow stress $k_{f0}$=initial value of the flow stress

T =deformation temperature

ϕ=degree of deformation

ϕp=deformation rate $A_i$; $m_i$=thermodynamic coefficients.

The thermodynamic coefficients were determined for different groups of materials; the materials within a group are differentiated by their respective $k_{f0}$ initial values.

In another treatise, "Modellierung des Einflusses der chemischen Zusammensetzung und der Umformbedingungen auf die Fließspannung von Stählen bei der Warmumformung" ("Modeling the Influence of the Chemical Composition and Deformation Conditions on the Flow Stress of Steels during Hot Forming"] by M. Spittel and T. Spittel, Freiberg, 1996, it is additionally proposed that the initial value of the flow stress of a material be determined as a function of its chemical analysis and that the remaining parameters be used to take into account the temperature, the degree of deformation, and the deformation rate according to the material group. Basically, however, the multiplicative character of the relation according to Equation (1) is retained.

The disadvantage of the multiplicative relation for determining the flow stress is that the function tends towards a flow stress of zero MPa with decreasing degrees of deformation ϕ<0.04 or reductions, i.e., the function passes through zero (shown in FIG. 1 for the prior art). However, this theory conflicts with the actual circumstances. As a result, flow stress values that are too low and thus set rolling forces that are too low are determined at low reductions. The setting of the set roll gap by the automatic gage control is dependent on the rolling force and is thus subject to error. The hot-rolled products have a greater actual thickness than the desired target thickness.

The erroneous set rolling force calculation at small degrees of deformation or reductions constitutes a permanent plant hazard during rolling at high rolling forces and/or rolling torques close to the maximum allowable plant parameters, as occur, for example, during rolling at lowered temperatures or even during at high temperatures and rolling stock widths close to the maximum width possible from the standpoint of plant engineering.

The erroneous set rolling force calculation also has an overall negative effect on process stability, since downstream automation models and automation control systems, such as profile and flatness models and control systems, determine their set values on the basis of the set rolling force.

WO 93/11886 A1 discloses a rolling program calculation method for setting the set rolling force and set roll gap of a rolling stand. This method uses stand-specific and/or material-specific rolling force adjustment elements. Stand-specific adjustments in the calculation of the set rolling force are a disadvantage with respect to transferability to other installations.

WO 99/02282 A1 discloses a well-known method for controlling or presetting the rolling stand as a function of at least one of the quantities rolling force, rolling torque, and forward slip, in which the modeling of the parameters is accomplished by means of information processing based on neural networks or by means of an inverted rolling model by back-calculation of the material hardness in the pass with the aid of a regression model. This makes it possible to avoid errors of the type that arise in the set rolling force calculation by the multiplicative relation in the range of small degrees of deformation or reductions. However, a disadvantage of this method is that rolling results must first be available for a neural network to be trained or for an inverted rolling model. Accordingly, the application of the proposed method to materials that have not yet been rolled or to installations with different parameters is not automatically guaranteed.

A common feature of the prior-art described above is that the effect of small degrees of deformation or small reductions on the flow stress during the hot rolling of steel and nonferrous materials is not taken into account correctly or sufficiently according to the previously known methods for calculating the set rolling force and for automatic gage control, or the transferability to other installations is limited, so that there are risks for the process stability, especially absolute gage precision and plant safety.

The objective of the invention is to develop a method for increasing process stability, especially absolute gage precision and plant safety, in the hot rolling of steel and nonferrous materials, in which the precision of the flow stress and the set rolling force at small degrees of deformation or small reductions can be increased.

In accordance with the invention, this objective is achieved by using the following relation to determine the yield point at elevated temperature as a function of the deformation temperature and/or deformation rate, which is then integrated in the function of the flow stress for determining the set rolling force $$R_e = a + e^{b1+b2 \cdot T} \cdot \square p^c \quad (2)$$

where $R_e$=yield point at elevated temperature

T=deformation temperature

□p=deformation rate a; b; c=coefficients

The advantage of using a new relation for calculating the flow stress is that the yield points at elevated temperature for the materials to be rolled are determined from measurement data of rollings with degrees of deformation smaller than a material-specific limiting degree of deformation by back-calculating the flow stresses of the given passes as a function of the deformation temperature and deformation rate from measured rolling forces and setting them equal to a yield point at elevated temperature when they are equal to the yield points at elevated temperature measured in hot tensile tests. The determined dependence of the yield point at elevated temperature on the deformation temperature and deformation rate represents the starting point of the approximated hot flow curve.

In accordance with the invention, it is further provided that a multiplicative flow curve relation is expanded by the yield point at elevated temperature as a function of the deformation temperature and deformation rate according to the formula $$k_{f,R}=a+e^{b1\cdot b2\cdot T}\cdot \square p^{c}\cdot k_{f0}\cdot A_1\cdot e^{m1\cdot T}\cdot A_2\cdot \square^{m2}\cdot A_3\cdot \square p^{m3} \quad (3)$$

Due to the fact that the invention takes into account the yield point at elevated temperature as a function of the deformation temperature and deformation rate, the method produces correct values even as very small degrees of deformation are approached. The starting value is the given yield point at elevated temperature of the material to be rolled as a function of the deformation temperature and deformation rate.

In accordance with the invention, it is further provided that the flow stress is integrated in the conventional rolling force equation for determining the set rolling force for the automatic gage control as well as for computational models and automatic control processes according to the following equation $$F_w=Q_p\cdot k_{f,R}\cdot B\cdot(R_w\cdot(h_0-h_1))^{1/2} \quad (4)$$

where $F_w$=set rolling force $Q_p$=function for taking into account the roll gap geometry and friction conditions $k_{f,R}$=flow stress, taking into account the yield point B=rolling stock width $R_w$=roll radius $h_0$=thickness before the pass $h_1$=thickness after the pass In a further refinement of the invention, it is provided that a material modulus is calculated on the basis of the set rolling force, taking into account the yield point at elevated temperature as a function of the deformation temperature and deformation rate for degrees of deformation smaller than a material-specific limiting degree of deformation, according to the formula $$C_M=(F_w-F_m)/dh_1 \quad (5)$$

where $C_M$=material modulus $F_w$=set rolling force $F_m$=measured rolling force $dh_1$=change in the runout thickness The invention is then developed in such a way that the conventional gage meter equation is expanded into the form $$ds_{AGC}=(1+C_M/C_G)dh_1=(1+C_M/C_G)\cdot((F_W-F_m)/C_G+S-S_{soll}) \quad (6)$$

where $ds_{AGC}$=change in the roll gap setting $C_M$=material modulus $C_G$=rolling stand modulus $dh_1$=change in the runout thickness $F_w$=set rolling force $F_m$=measured rolling force s=adjustment of the roll gap $s_{soll}$=desired adjustment of the roll gap As a result, the material flow behavior at small degrees of deformation or reductions is now also correctly represented. The adjustment position of the electromechanical and/or hydraulic adjustment for guaranteeing the runout thickness of the rolling stock is determined on the basis of the gage meter equation and the calculated set rolling force.

The figures show graphs for the flow stress as a function of the degree of deformation in accordance with the prior art and in accordance with the invention and are explained in greater detail below.

Figure 1:
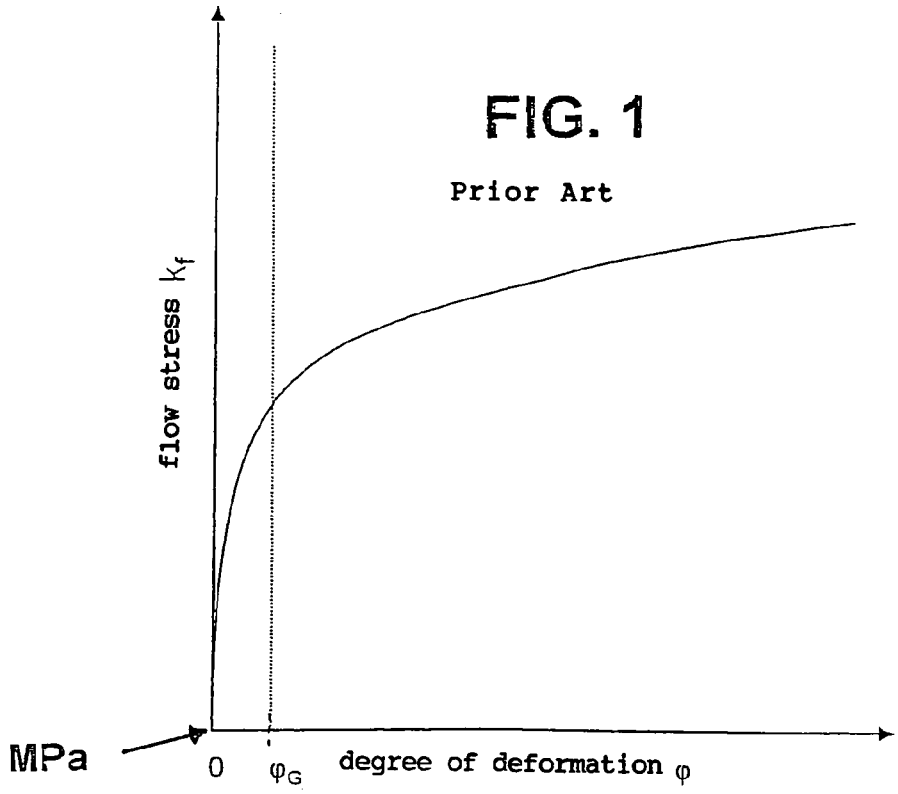
FIG. 1 Prior Art
FIG. 1 shows schematically the behavior of the flow stress $k_f$ as a function of the degree of deformation $\phi$ with the conventional multiplicative relation (prior art).

The disadvantage of the multiplicative relation for determining the flow stress (FIG. 1) is that the function tends towards a flow stress $k_f$ of zero MPa at small degrees of deformation $\phi<0.04$ or small reductions, i.e., the function passes through zero, as plotted in the graph.

Figure 2:
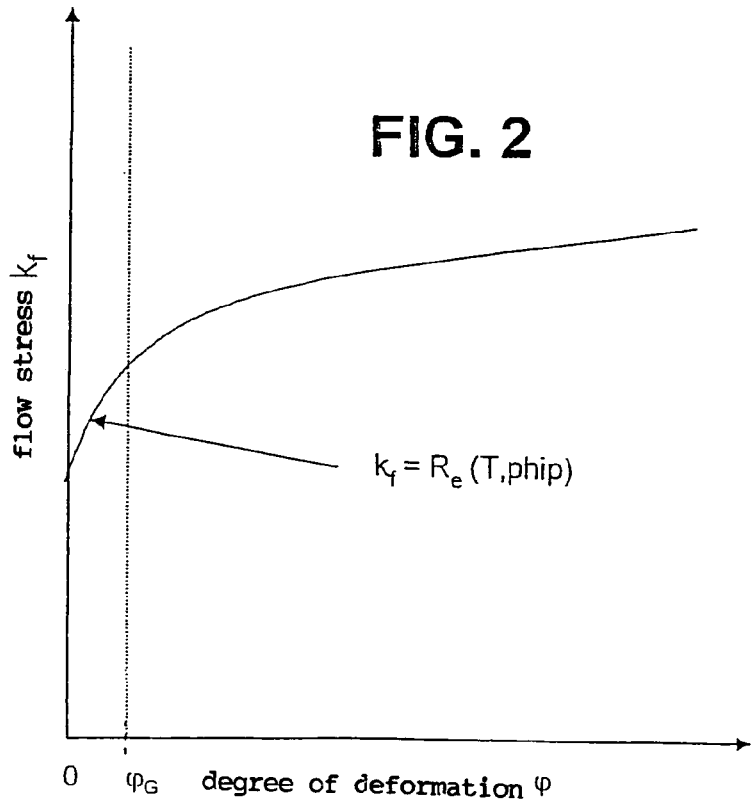
FIG. 2 shows schematically the behavior of the flow stress $k_{f,R}$ as a function of the degree of deformation $\phi$ in accordance with the invention, wherein below the limiting degree of deformation $\phi_G$, the multiplicative relation is additively expanded by the yield point at elevated temperature.

Due to the fact that the invention (FIG. 2) takes into account the yield point at elevated temperature $R_e$ as a function of the deformation temperature T and deformation rate $\square p$, the method of the invention produces correct values even as very small degrees of deformation $\phi$ are approached. The starting value is the given yield point at elevated temperature $R_e$ of the material to be rolled as a function of the deformation temperature T and deformation rate $\phi p$.

LIST OF REFERENCE SYMBOLS $A_i$ thermodynamic coefficients
$a_i$ $b_i$, c coefficients
B rolling stock width
$C_G$ stand modulus
$C_M$ material modulus
$dh_1$ change in the runout thickness
$ds_{AGC}$ change in the roll gap setting
$F_m$ measured rolling force
$F_w$ set rolling force
$h_0$ thickness before the pass
$h_1$ thickness after the pass
$k_f$ flow stress
$k_{f0}$ initial value of the flow stress
$k_{f,R}$ flow stress, taking into account the yield point
$m_i$ thermodynamic coefficients
$\phi$ degree of deformation
$\phi_G$ limiting degree of deformation
$\phi p$ deformation rate
$Q_p$ function for taking into account the roll gap geometry and friction conditions
$R_e$ yield point at elevated temperature
$R_w$ roll radius
s adjustment of the roll gap
$S_{soll}$ desired adjustment of the roll gap
T deformation temperature

The invention claimed is:

1. Method for hot rolling of steel or nonferrous materials with small degrees of deformation (ϕ) or small reductions, comprising the steps of:

calculating a set rolling force ($F_w$) and a given adjustment position (s) by taking into account a yield point at elevated temperature (Re); and determining the yield point at elevated temperature ($R_e$) as a function of deformation temperature (T) and/or deformation rate (ϕp), which is then integrated in the function of flow stress ($k_{f,R}$) for determining the set rolling force ($F_w$), using the relation $$R_e = a + e^{b1+b2\cdot T} \cdot \dot{\phi}p^c \tag{2}$$

by expanding a multiplicative flow curve relation by the yield point at elevated temperature ($R_e$) as a function of the deformation temperature (T) and deformation rate (ϕp) according to the formula $$k_{f,R} = a + e^{b1+b2\cdot T} \cdot \dot{\phi}p^c \cdot k_{f0} \cdot A_1 \cdot e^{m1\cdot T} \cdot A_2 \cdot ]^{m2} \cdot A_3 \cdot \dot{\phi}p^{m3} \tag{3}$$

in order to hot roll steel or nonferrous materials, where $R_e$=yield point at elevated temperature T =deformation temperature ϕp=deformation rate a,; $b_i$; c=coefficients

2. Method in accordance with claim 1, wherein the flow stress ($k_{f,R}$) is integrated in conventional rolling force equation for determining the set rolling force ($F_w$) for automatic gage control as well as for computational models and automatic control processes according to the following equation $$F_w = Q_p \cdot k_{f,R} \cdot B \cdot (R_w \cdot (h_0 - h_1))^{1/2} \tag{4}$$

where $F_w$=set rolling force $Q_p$=function for taking into account the roll gap geometry and friction conditions $k_{f,R}$=flow stress, taking into account the yield point B=rolling stock width $R_w$=roll radius $h_0$=thickness before the pass $h_1$=thickness after the pass.

3. Method in accordance with claim 1, wherein a material modulus ($C_M$) is calculated on the basis of the set rolling force ($F_w$), taking into account the yield point at elevated temperature ($R_e$) as a function of the deformation temperature (T) and deformation rate (ϕp) for degrees of deformation smaller than a material-specific smaller than a material-specific limiting degree of deformation ($\phi_G$), according to the formula $$C_M = (F_w - F_m)/dh_1 \tag{5}$$

where $C_M$=material modulus $F_w$=set rolling force $F_m$=measured rolling force $dh_1$=change in the runout thickness.

4. Method in accordance with claim 3, wherein a conventional gage meter equation is expanded into the form $$ds_{AGC} = (1 + C_M/C_G)dh_1 = (1 + C_M/C_G) \cdot ((F_w - F_m)/C_G + S - S_{soll}) \tag{6}$$

where $ds_{AGC}$=change in the roll gap setting $C_M$=material modulus $C_G$=rolling stand modulus $dh_1$=change in the runout thickness $F_w$=set rolling force $F_m$=measured rolling force S=adjustment of the roll gap $S_{soll}$=desired adjustment of the roll gap.

* * * * *